US005452825A

United States Patent [19]

Comstock et al.

[11] Patent Number: 5,452,825

[45] Date of Patent: Sep. 26, 1995

[54] LIQUID DISPENSER FOR VERTICAL WALL MOUNTING

[75] Inventors: Roger D. Comstock; Ryan K. Tischner, both of Orem; Wayne E. Pearce, Provo, all of Utah

[73] Assignee: Better Living Products, Inc., Provo, Utah

[21] Appl. No.: 98,340

[22] PCT Filed: Feb. 11, 1992

[86] PCT No.: PCT/US92/01182

§ 371 Date: Oct. 12, 1993

§ 102(e) Date: Oct. 12, 1993

Related U.S. Application Data

[63] Continuation-in-part of Ser. No. 653,142, Feb. 11, 1991, Pat. No. 5,183,182.

[51] Int. Cl.[6] ..... B67D 5/52

[52] U.S. Cl. ..... 222/135; 222/325; 222/341; 222/514; 222/181.2; 222/153.03

[58] Field of Search ..... 222/129, 135, 222/153, 156, 157, 181, 325, 341, 514, 559

[56] References Cited

U.S. PATENT DOCUMENTS

| | | | |
|---|---|---|---|
| 3,078,016 | 2/1963 | Judy | 222/181 |
| 3,195,777 | 7/1965 | Hart | 222/181 |
| 3,814,294 | 6/1974 | Stevenson | 222/181 |
| 3,920,160 | 11/1975 | Casale et al. | 222/181 |
| 3,955,715 | 5/1976 | Topor | 222/181 X |
| 3,987,932 | 10/1976 | Maldon | 222/129 |
| 4,159,788 | 7/1979 | Doyel | 222/181 |
| 4,164,306 | 8/1979 | Perrin | 222/181 |
| 4,166,553 | 9/1979 | Fraterrigo | 222/181 |
| 4,238,056 | 12/1980 | Tucker et al. | 222/181 |
| 4,324,348 | 4/1982 | Johnson et al. | 222/181 |
| 4,470,523 | 9/1984 | Spector | 222/181 |
| 4,667,854 | 5/1987 | McDermott et al. | 222/181 |
| 4,715,517 | 12/1987 | Potter et al. | 222/181 |
| 4,741,461 | 5/1988 | Williamson et al. | 222/181 |
| 4,793,517 | 12/1988 | Washut | 222/129 |
| 4,880,145 | 11/1989 | McManus | 222/181 |
| 4,886,192 | 12/1989 | Cassia | 222/181 |
| 5,033,657 | 7/1991 | Whittington | 222/181 |
| 5,145,095 | 9/1992 | Loudon | 222/341 X |
| 5,248,066 | 9/1993 | Olson et al. | 222/181 X |

FOREIGN PATENT DOCUMENTS

| | | | |
|---|---|---|---|
| 269668 | 6/1965 | Australia | 222/181 |
| 749596 | 1/1967 | Canada | 222/181 |

OTHER PUBLICATIONS

Two pages of advertisement from "Solutions" of Portland, Oreg. for a two or four section shower soap dispenser, Jan. 1991.

*Primary Examiner*—Andres Kashnikow
*Assistant Examiner*—Joseph A. Kaufman
*Attorney, Agent, or Firm*—Mallinckrodt & Mallinckrodt

[57] ABSTRACT

A liquid dispenser device comprising a shell (24) adapted to be wall-mounted substantially vertically in a bathing or washing area and to removably and replaceably receive and hold one or more elongate bottles (20) for liquids useful before, after, or while bathing, each bottle (20) having a valve assembly (22) operable by a push button (74) along an axis extending substantially normal to the longitudinal axis of its associated bottle as positioned substantially vertically for use. The shell (24) has a hinged and preferably lockable cover part (28) that can be propped open when raised for allowing a bottle (20) to be removed for refilling. Most of the components of the dispenser device are preferably fabricated from a thermoplastic, as by well-known injection molding techniques.

10 Claims, 6 Drawing Sheets

LIQUID DISPENSER FOR VERTICAL WALL MOUNTING

RELATED APPLICATIONS

This is a continuation-in-part of our application Ser. No. 653,142, filed Feb. 11, 1991, now U.S. Pat. No. 5,183,182.

BACKGROUND OF THE INVENTION

Field

This invention is in the field of liquid dispensers adapted for attachment to a wall in or near a shower bath or other bathing facility and to contain liquid soap, shampoo, and other cleansing or grooming liquids normally used before, during, or after bathing.

State of the Art

Many wall mounted devices for dispensing liquids are known. However, the manner in which they are refilled after use poses a problem. Specifically, a number of these prior art devices are permanently mounted on a wall and hence must be refilled without removal from the mounting location. Such refilling can be hazardous since dispensing devices of this nature are commonly mounted in a shower or bathtub where it is both slippery and difficult to maneuver. Those that are detachable from their mountings require either disassembly or the exertion of considerable effort to remove. Some have portable containers that must be discarded and replaced with new full containers. Further, valves used in these devices to dispense the contained liquids are prone to leak and thereby produce hazardous conditions in the bathing area.

SUMMARY OF THE INVENTION

In accordance with the invention, a shell adapted to be wall-mounted includes a hinged cover and a desired number of completely removable bottles, each provided with its own no-drip valve assembly which may be easily detached for cleaning or repair if necessary. The shell is adapted for mounting on the wall of a shower or at a wall location near a sink preferably by either the use of screws, with or without anchors set into the wall, or by a two-sided adhesive pad carrying a silicone glue.

Manually-operated push buttons for opening resiliently closed valves extend through the cover of the shell for ready accessibility, and such cover is preferably constructed to stay propped open when lifted for removal of one or more of the individual bottles for refilling. Apertures may be provided in the cover of the shell for viewing the level of liquid in the respective bottles as they reach the near empty stage.

The component parts of the shell are advantageously molded from,a thermoplastic material and preferably include an integrally formed latch arrangement that releasibly secures the cover in its closed position and that permits it to be lifted to open position.

The bottles, with their respective valve assemblies, are each mounted within the shell by integrally molded guide members and jaw members, the jaw members enabling the valve assemblies to be snapped into place in the shell. Each bottle has its corresponding valve attached over a discharge opening at the bottom of the bottle, preferably by screw threads, and has a fill-opening at its top preferably covered by a soft plastic lid, which has a small hole to allow air to flow freely into the bottle as the contents are depleted. The bottles are preferably made of a clear plastic material and are easily removed from and replaced in the shell.

The valves are preferably constructed of preformed, injection molded, thermo plastic components that snap together and are held without aid of glue or other adhesive means. Each valve is spring biased to closed leak free condition, and is opened manually by a readily accessible push button to pump the desired liquid from the corresponding bottle into the cupped hand or hands of the user held directly below.

THE DRAWINGS

In the drawings, which represent the best mode presently contemplated for carrying out the invention in actual practice:

FIG. 1 represents a perspective view looking toward the front of a liquid dispenser device of the invention having multiple bottles for liquid to be dispensed and showing how it would appear as attached to the wall of a shower or other bathing or washing area;

FIG. 2, a bottom plan view of the device of FIG. 1 as there shown;

FIG. 3, a corresponding view in side elevation;

FIG. 4, a rear elevational view;

FIG. 5, a view corresponding to that of FIG. 1, except with the cover in the open position;

FIG. 6, a view in side elevation of one of the containers and its valve assembly as removed from the liquid dispenser device of FIG. 1;

FIG. 7, a fragmentary front perspective view of the dispenser device of FIG. 1 with cover open and the containers and their valve assemblies removed;

FIG. 8, a fragmentary detail section taken along the line 8—8 of FIG. 2 and drawn to a larger scale;

FIG. 9, a similar view taken along the line 9—9 of FIG. 5;

FIG. 10, a vertical axial section through a valve as taken on the line 10—10 of FIG. 2, with the shell omitted;

FIG. 11 an exploded view of the valve assembly of FIG. 10, with the several parts being shown in elevation;

FIG. 12, a detail view in top plan of the valve body per se as viewed from thus line 12—12 of FIG. 11;

FIG. 13, a vertical axial section through the valve housing taken on the line 13—13 of FIG. 12;

FIG. 14, a view corresponding to that of FIG. 6 but exploded to show how the cover of the bottle may be removed for refilling of the bottle and to show the several internal parts of the check valve, an intermediate part of the bottle being broken out for convenience of illustration;

FIG. 15, a view corresponding to the lower part of FIG. 1, considerably enlarged and with portions of the front wall broken away to reveal otherwise hidden structure, but showing another embodiment having snap locking and key unlocking means instead of the thumb-operated latching means of the first embodiment; and FIG. 16, a fragmentary vertical section taken on the line 15—15 of FIG. 14 and otherwise corresponding to FIG. 8.

DETAILED DESCRIPTION OF THE ILLUSTRATED EMBODIMENT

Figure 5:
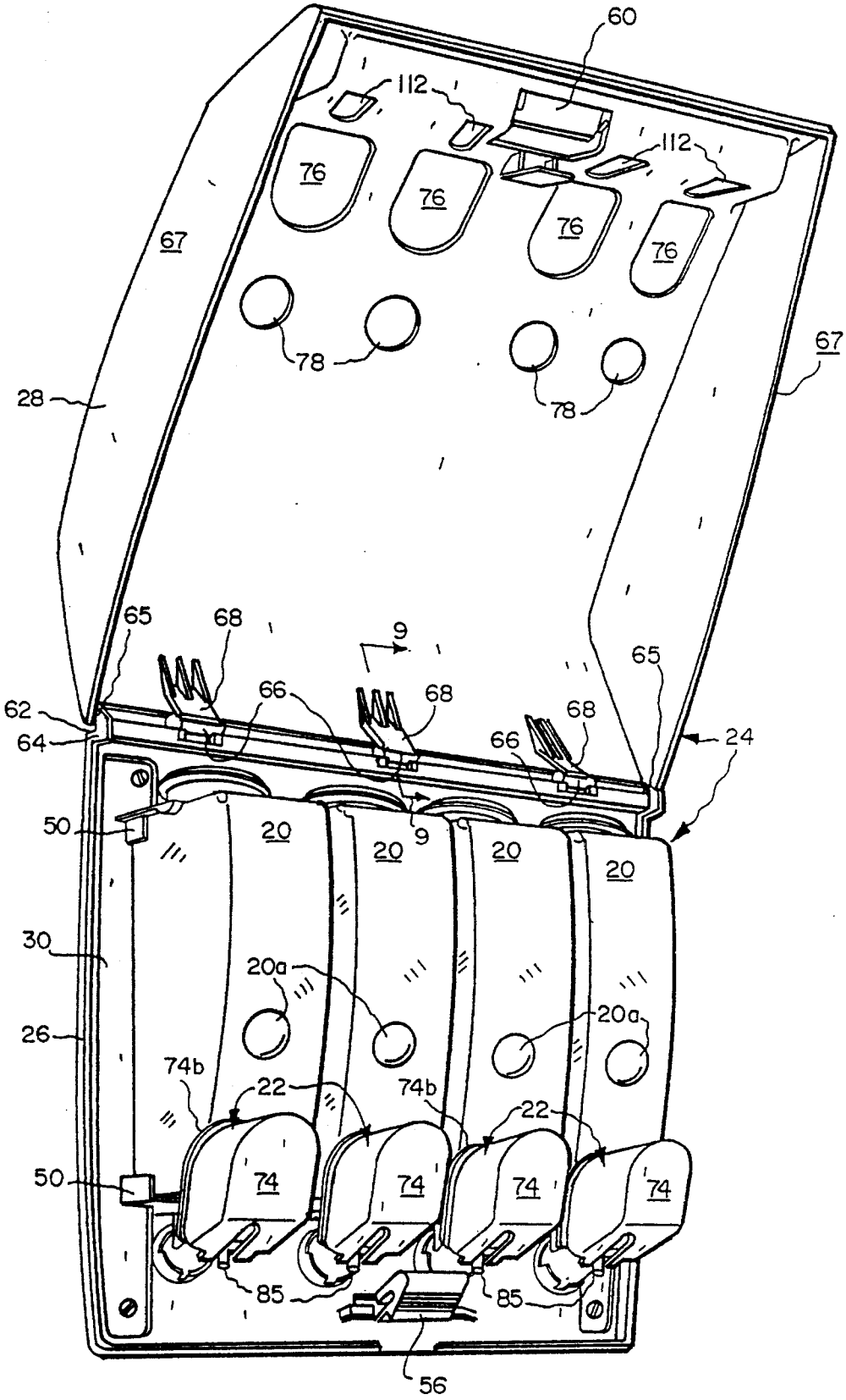

The dispenser device of the invention in its presently preferred form comprises a plurality (here shown as four) of identically shaped and fabricated bottles 20, FIG. 5, for holding various liquids, respectively, useful for example in the bath, each bottle having a compression-activated, liquid-releasing valve 22 attached thereto. The bottles are removably held within a shell 24, which is adapted to be mounted on a vertical wall in a shower or other bathing or washing area.

Figure 4:
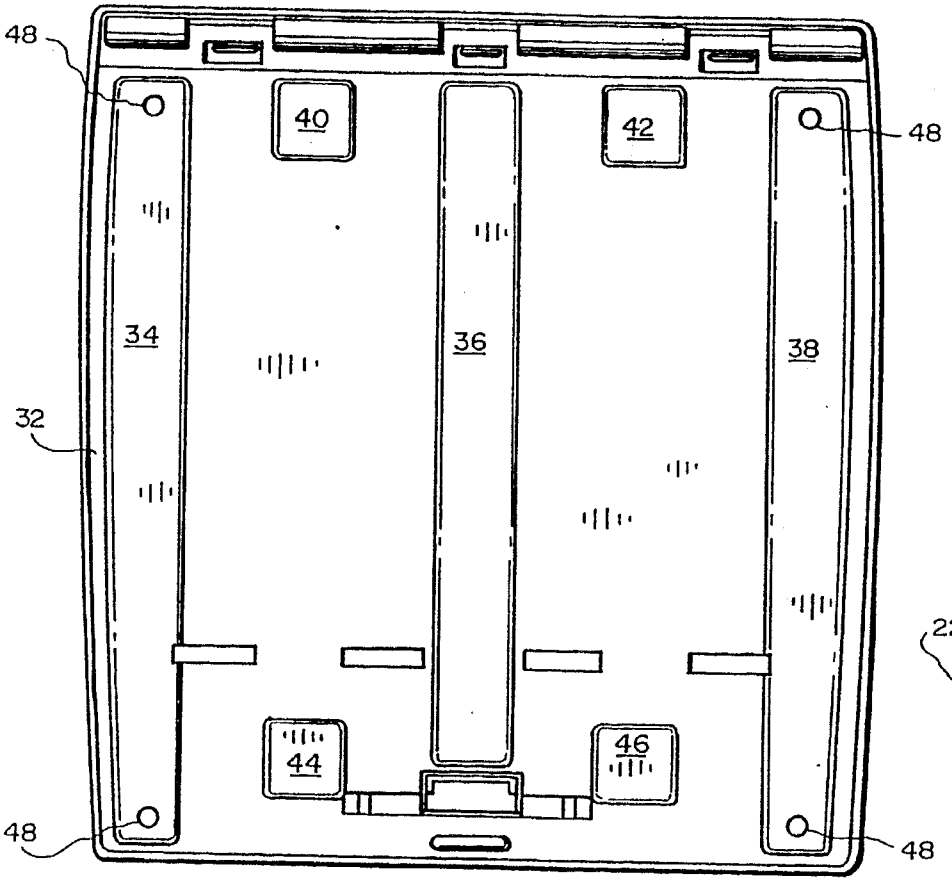
Figure 3:
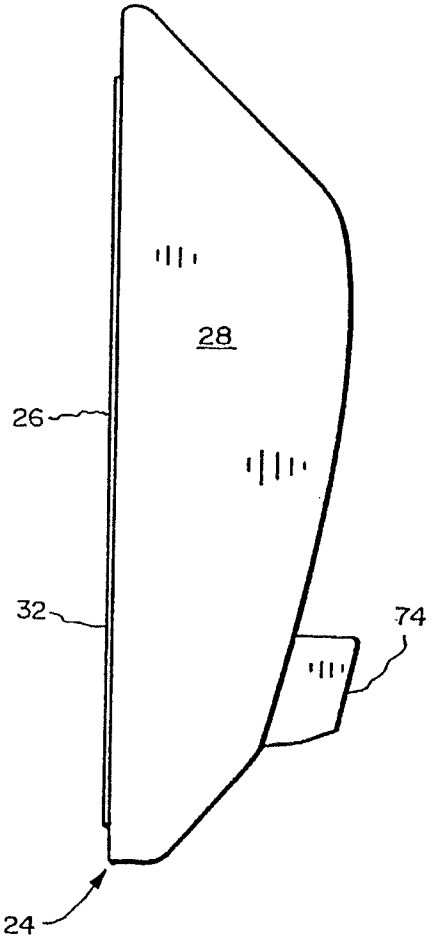

As shown, shell 24 has two main parts, a bottle-holding part 26, which is adapted to be mounted directly on a wall, and a hinged cover part 28. Together, holder part 26 and cover part 28 receive and enclose the bottles 20 and their respective valves 22. These two parts are desirably separately injection molded in conventional manner from a suitable thermoplastic material of stiffly resilient character to provide snap-action holding capability for retaining the bottles 20, and for latching capability .relative to each other. Holder part 26 has a broad front or inside face 30 arranged to receive and hold the bottles and a broad back face 32, FIG. 7, adapted to confront and attach to a supporting wall surface by means of an adhesive and/or screws. Back face 32, as shown in FIG. 4, has three raised strips 34, 36 and 38 and four raised squares 40, 42, 44 and 46. The strips are raised slightly higher than the squares for receiving a silicone-based glue which may be used to attach the dispenser device to a vertical wall. Each of the squares 40, 42, 44 and 46 can receive a piece of two-sided adhesive foam. The adhesive foam and glue provide one-way the dispenser device can be securely mounted.

Strips 34 and 38, as shown, each have a hole 48 drilled or otherwise formed therethrough near each end. Each hole 48 can accommodate a screw, this being an additional or alternative way the dispenser device can be mounted on a wall.

Figure 7:
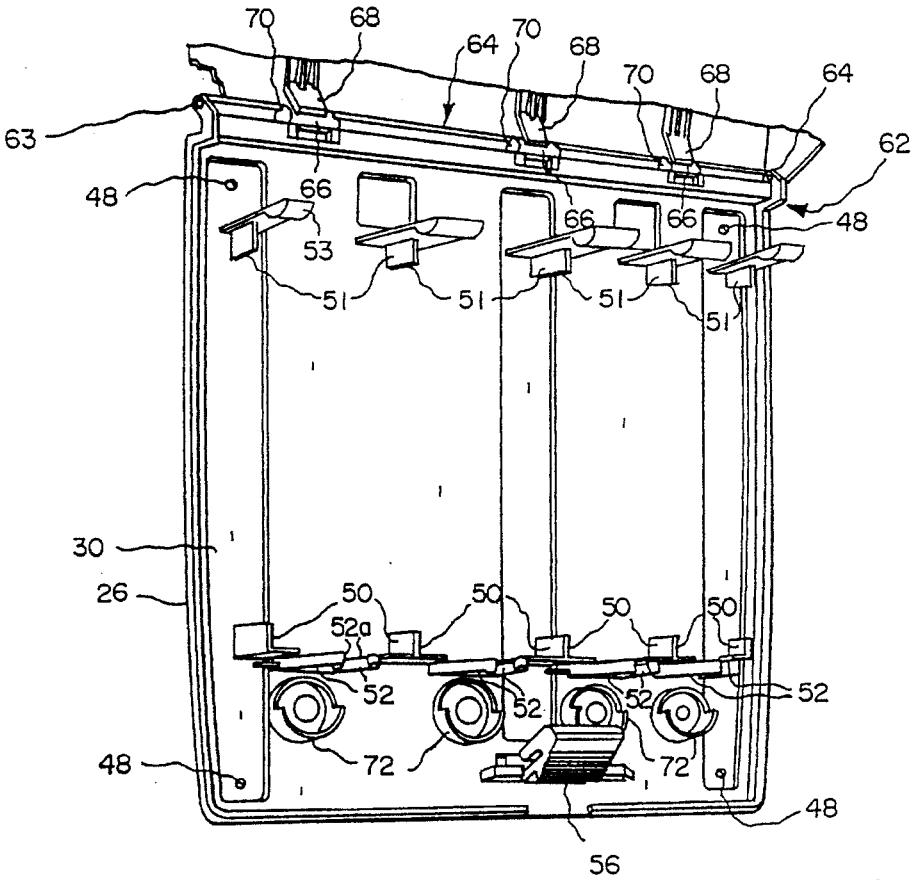

The inside face 30 of shell part 26 includes sets of integrally molded, upstanding, lower corner guide members 50, FIGS. 5 and 7, upper side guide members 51, and also corresponding sets of paired jaw members 52, FIG. 7, for receiving and holding the respective bottles 20 with their valve assemblies 22. Preferably, upper holding members 53 extend from face 30 and snap into receiving recesses 54 in the tops of bottles 20 when in position on bottle holder part 26. An advantage of this arrangement is that each bottle 20 can be quickly and easily removed separately as and when required for refilling or cleaning. As shown, the tips 52a of each set of jaw members 52 are biased slightly inwardly toward each other in the form of tabs to maintain a firm grip on the valves 22 after such valves are snapped into place.

Bottle holder part 26 of the shell also has a latch piece 56 integrally molded therewith and rising from face 30 thereof for snap locking engagement with a cooperative latching part 60, FIG. 5, on cover part 28 of the shell to latch the shell in closed condition during use. Cover part 28 is released by pressing inwardly against latch piece 56.

The two parts 26 and 28 of the shell are hinged together along the back margin thereof which is uppermost in the wall-installed position of the .shell and which is opposite the latching members 56 and 60.

Figure 9:
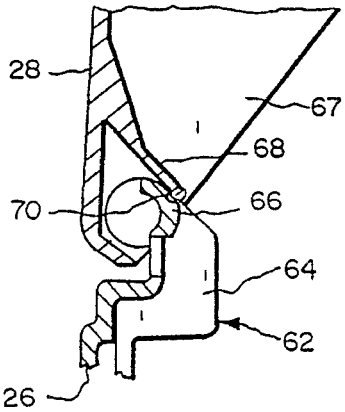

For this purpose, bottle-holding part 26 is provided along its back margin with a raised formation 62, FIGS. 5, 7, and 9, having, at its opposite ends, openings 63, FIG. 7, for receiving respective stub pintles 64 projecting inwardly from the back ends of cover side walls 65 which overlap the opposite ends of formation 62.

A unique feature of the dispenser device of the invention as preferably constructed is the provision of means, FIGS. 5, 7, and 9, for automatically propping cover part 28 of shell 24 open in the vertical wall-mounted position of the device. This enables the user to conveniently and safely remove and replace the bottles 20 for refilling, to service the valve assemblies 22, and to conveniently mount the device on a wall with screws, if desired. As shown, formation 62 is provided with a series of arcuate retaining members 66 extending longitudinally therealong concentrically with the hinge axis, and cover part 28 is provided with a corresponding series of resilient tabs 68 bearing against such retaining members, respectively, to seat in respective grooves 70, FIG. 9, when the cover part is fully raised.

Figures 11, 12, 13, 14:
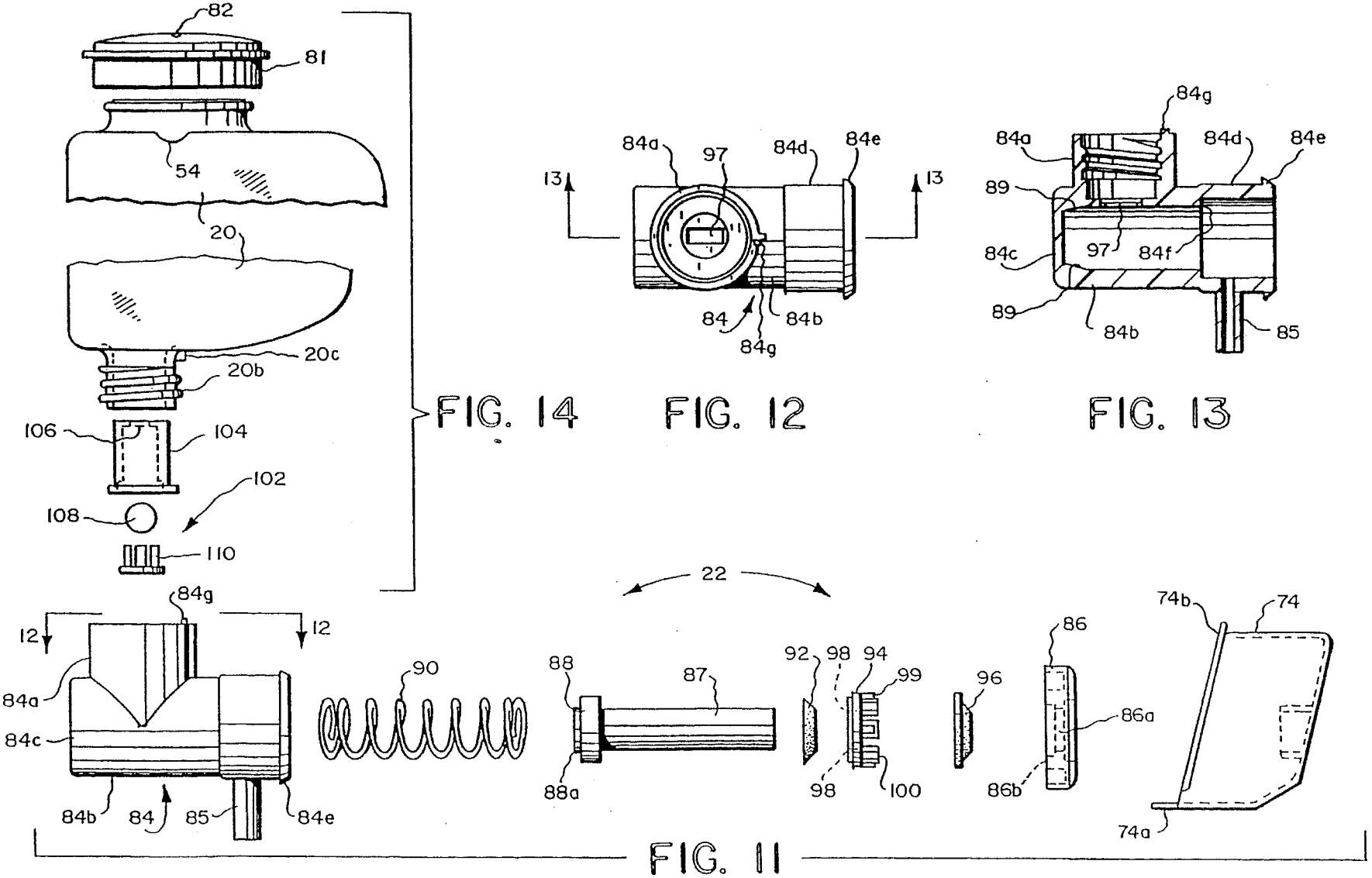

Each bottle 20 is preferably molded from a transparent thermoplastic material of shape that provides for close side-by-side positioning of a plurality of bottles on the inside face 30 of holder shell part 26, with closed ends 84*c*, FIG. 13, of their valves 22 abutting such face 30 within respective receiving and positioning rings 72, FIG. 7, that are desirably integrally molded with such shell part and rise from such face 30.

Figure 1:
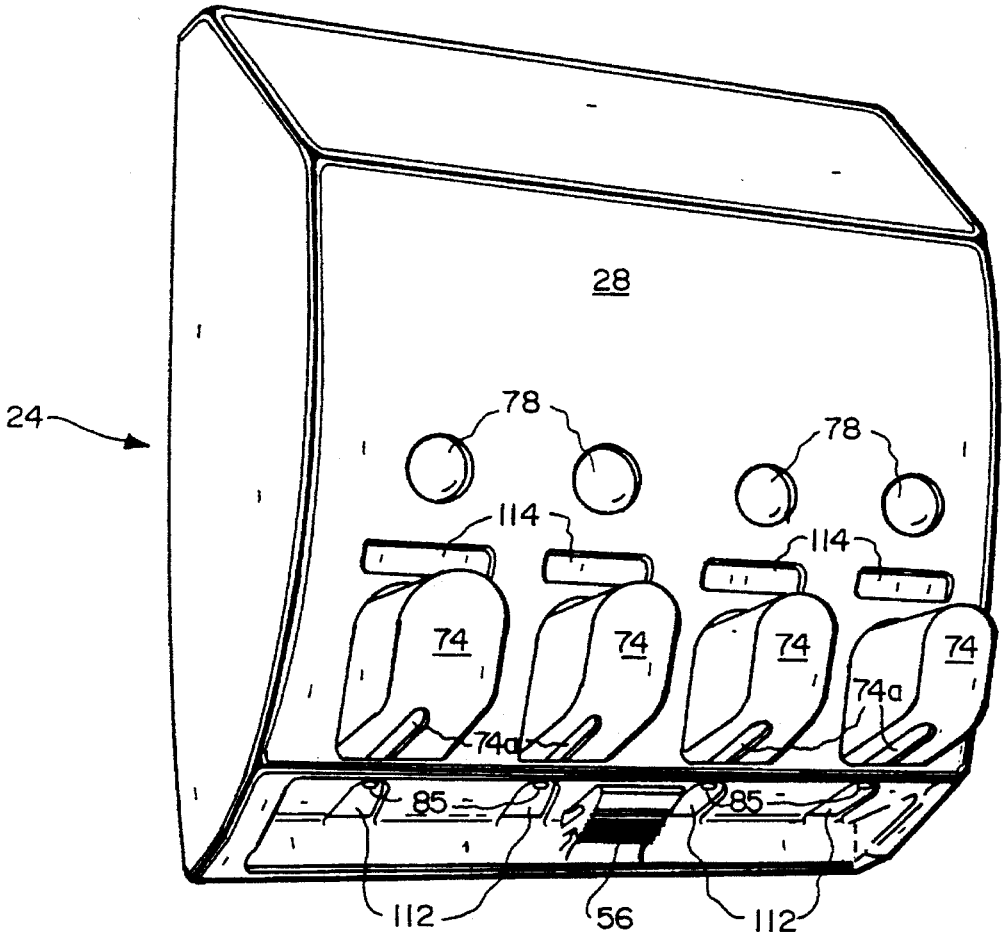

Valves 22 are arranged to open and close along respective axes that extend at right angles to the longitudinal axes of the respective bottles 20 so their manually actuatable push buttons 74 will confront and be readily accessible to the user when the device is mounted vertically on a wall as shown in FIG. 1.

Figure 10:
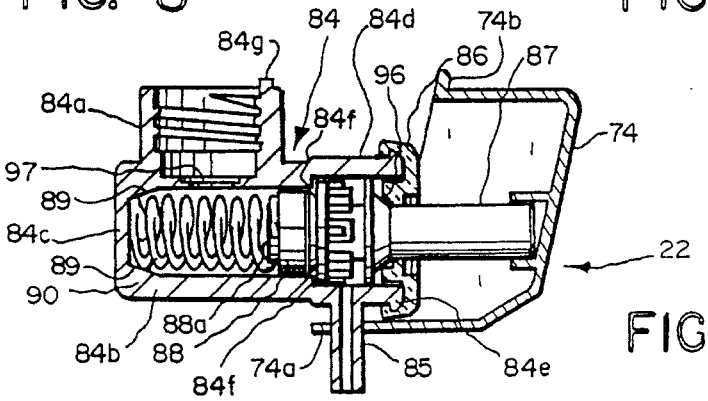

For accommodating push buttons 74, cover part 28 is correspondingly apertured, as at 76, FIG. 5, so that such push buttons and the portions of valves 22 covered thereby will project through and be accessible from outside of shell 24. Push buttons 74 preferable each have a radially extending flange 74*b*, FIGS. 5, 10 and 11, extending from the sides and top of the rearward portion of the push button. Flanges 74*b* will keep the push button from falling through holes 76 and will block the line of sight through holes 76 around the outside of push button 74 to provide a more pleasing appearance to the dispenser device. It is advantageous also that cover part 28 have openings 78 above the push buttons so that lowering of liquid level in the respective bottles 20 can be observed to warn the user when refilling of the bottle or bottles concerned should take place. For filling and refilling, each bottle 20 has a top opening normally closed by a replaceable cover 81, FIGS. 6 and 14, which is provided with a small opening 82 establishing communication of the interior of the bottle with the atmosphere. Also, it is preferable that each bottle have a window 20*a*, FIGS. 5 and 6, for intrusion into the corresponding opening 78 of shell cover part 28 where such part is closed.

Each of the valves 22 comprises an assembly of mechanism, FIGS. 10–13, operably housed in a valve body 84, of right angular configuration having an internally threaded, normally upstanding, portion 84*a* adapted to screw onto an externally threaded, depending, outlet nipple 20*b*, FIG. 14, of a bottle 20, and having a normally horizontal body portion 84*b* at right angles to portion 84*a* and into which is fitted the valve mechanism to be manually operated by push button 74. A discharge spout 85 depends from the open, push-button-mounting end portion 84*d* of valve body portion 84*b*, which open end portion is closed by an annular slideway cap 86, FIGS. 10 and 11, through a central opening 86*a* of which slidably extends a piston or plunger rod 87 on which push button 74 is mounted and has a piston or plunger head 88 against which one end of a coil spring 90 bears. The other end of spring 90 bears against the closed end 84*c* of valve body 84. A central ring 88*a*, FIGS. 10 and 11, extending from the face of plunger head 88 into spring 90 may be provided to hold spring 90 centered with respect to piston head 88, and ribs 89, FIG. 10, spaced around closed end 84*c* of valve body 84 may be provided to keep spring 90 centered in the valve body. Four such ribs have been found satisfactory. Slideway cap 86 is desirably formed of a resilient thermoplastic material that snaps into fixed position over an annular lip 84*e* formed externally of the open end of valve body portion 84*d*.

Figure 6:
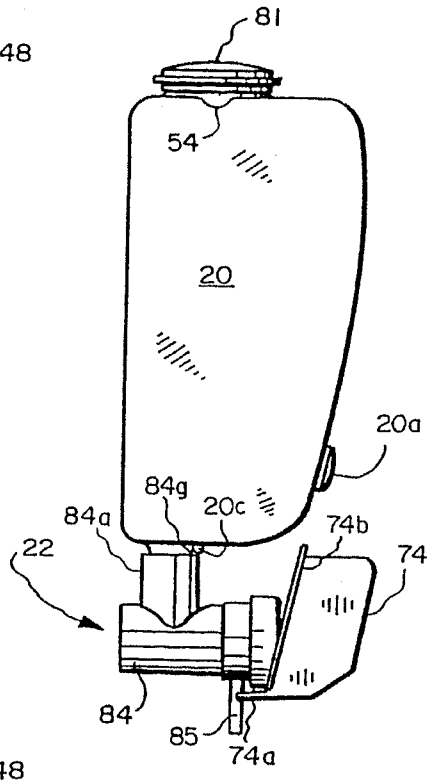

Upstand valve portion 84*a* may include a tab 84*g* extending upwardly therefrom to abut a stop 20*c*, FIGS. 6 and 14, extending downwardly from bottle 20 at the upper end of outlet nipple 20*b*. When valve 22 is screwed onto nipple 20*b*, tab 84*g* will abut stop 20*c* to properly align valve 22 with bottle 20 for insertion of bottle 20 onto bottle holding part 26 so that push buttons 74 will be aligned with apertures 76 of cover part 28.

A sealing washer 92 is carried by piston or plunger rod 87 and is normally pressed against the underside of piston or plunger head 88 by a slide ring 94 and by a second sealing washer 96 (both washers and the slide ring being slidably carried by piston or plunger rod 87) under the resilient action of spring 90. When push button 74 is pushed by a user to discharge liquid from the bottle through spout 85, slide ring 94 and washer 96 are restrained from following piston or plunger head 88 under the restricted opening 97, FIGS. 12 and 13, of valve body portion 84*a* by an annular internal shoulder 84*f*, FIG. 13, of valve body 84. Since slide ring 94 is formed with a series of diametrically opposite openings 98 therethrough leading to a corresponding series of passages 99 between teeth members 100, liquid flows around piston or plunger head 88 and sealing member 92, piston or plunger rod 87, and through openings 98 and passages 99 into, through, and out of discharge spout 85 and into the cupped hands of the user held therebelow while push button 74 is pushed or released. With runny liquids, the liquid will continue to run through the valve and out the spout as long as the push button is held pressed by a thumb or finger of the user. With viscus liquids, such as most shampoos, conditioners, and liquid soaps, the pumping action of the piston moving back and forth in the valve body is needed to discharge the liquid. Release of the push button enables spring 90 to push the piston or plunger back into valve-closed position, with washer 92 firmly seated against slide ring 94 to effectively prevent leakage of liquid from bottle 20 through spout 85. Spring 90 should be strong enough to ensure a good seal between washer 92 and slide ring 94. Second sealing washer 96 seals against an annular seat member 86*b* of slideway cap 86 to prevent leakage around plunger rod 87.

Push button 74 preferably has a rearwardly extending and slotted guide member 74*a*, FIG. 11, that engages spout 85 during the back and forth movement of such push button.

To prevent backflow of any liquid from dispensing valve 22 into bottle 20 through outlet nipple 20*b* thereof during the movement of plunger rod 87 and plunger head 88, such nipple is provided with a check valve 102, FIG. 14, comprising in this instance an insert valve body 104 having a valve seat 106 defining the opening for discharge of liquid from the bottle. A ball 108 is confined internally of valve body 104 between valve seat 106 and the upper end of a circumferential series of upstanding, spaced arms 110 that normally support ball 108 in position to immediately rise with any backflow of liquid from valve 22 and seat against valve seat 106 to prevent further backflow. When ball 108 rests on top of arms 110, as it does normally, liquid from bottles 20 flows freely into dispensing valve 22.

Figure 2:
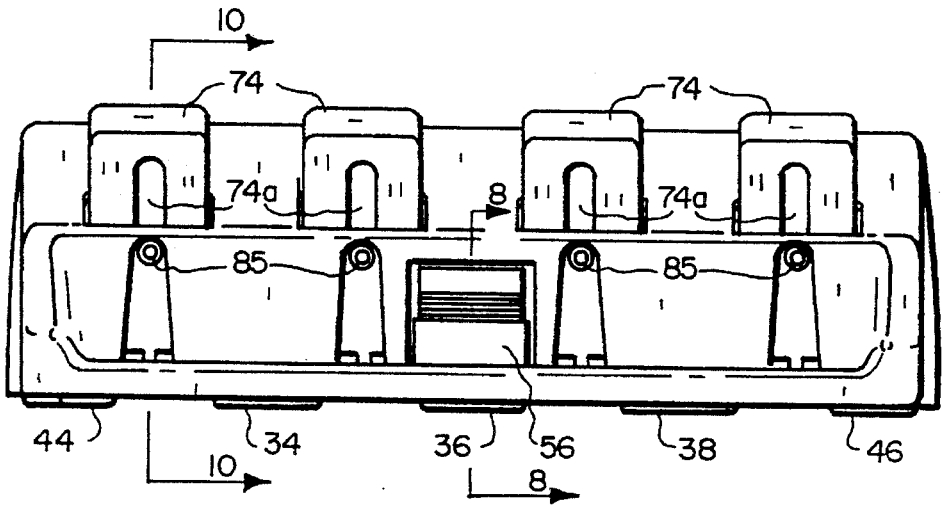

The valve spout 85 of each bottle 20 is directed toward a corresponding opening 112, FIG. 1, 2, and 5, in cover part 28 of shell 24 and the dispensed liquid drops through such opening into the hand or hands of the user. It is preferred that spout 85 be long enough to actually extend at least partially through opening 112 to ensure that liquid discharged will not build up on the inside of the shell.

It is advantageous that recesses 114, FIG. 1, be provided in shell cover part 28 above the respective push buttons 74 for the reception of name plates identifying the liquids in the respective bottles 20.

Figure 8:
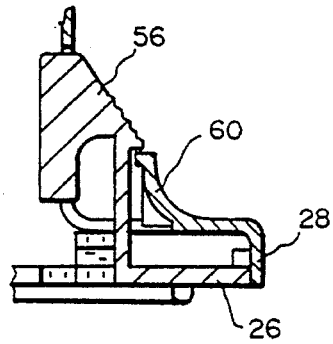
Figure 15:
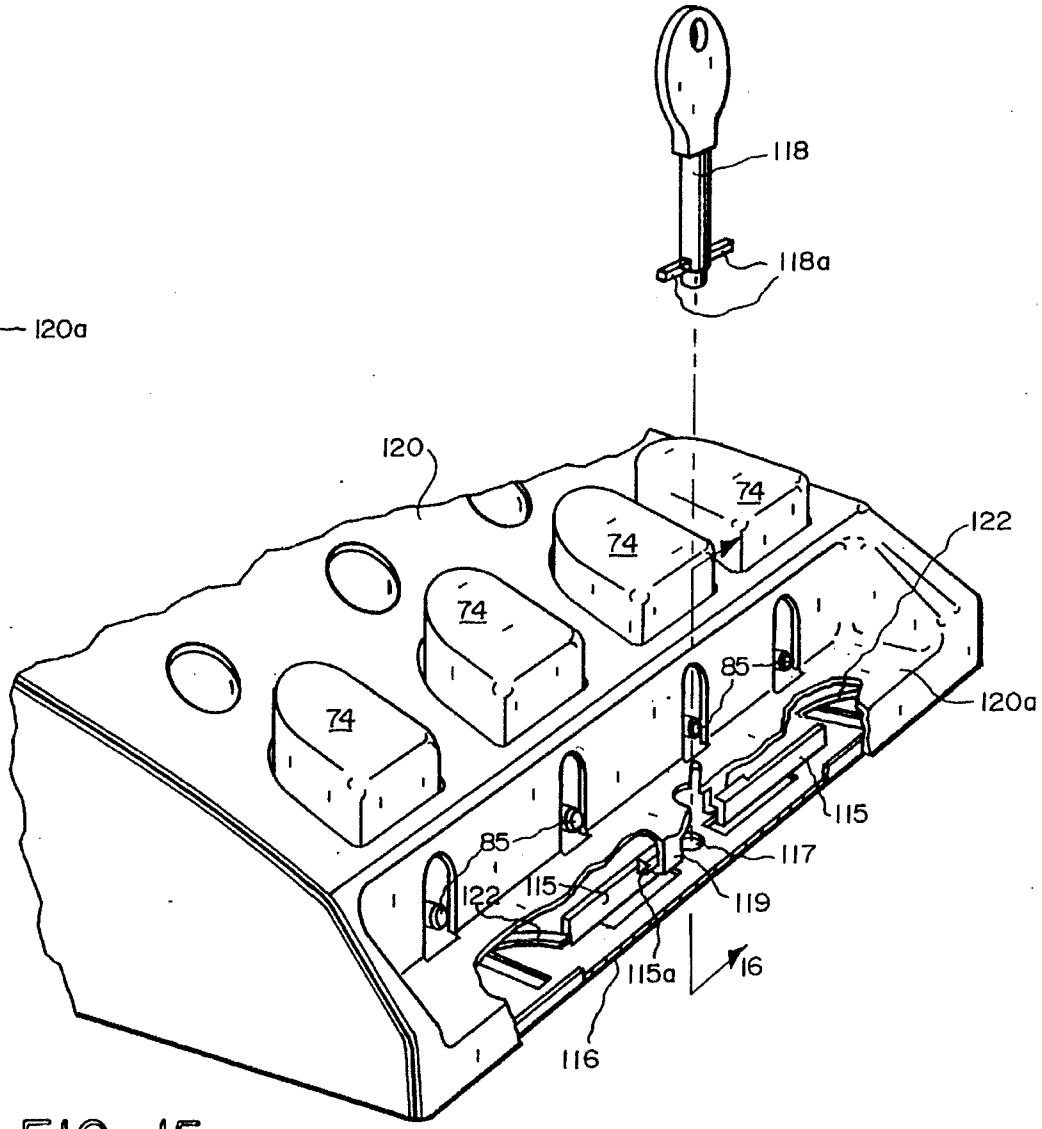
Figure 16:
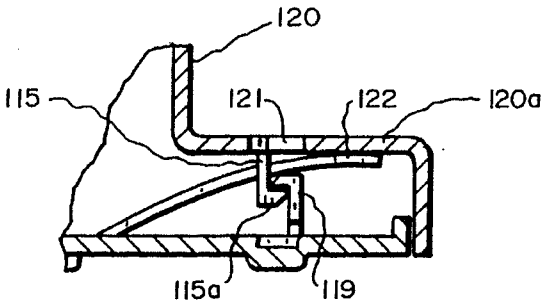

The embodiment of FIGS. 15 and 16 corresponds in major respects to the foregoing embodiment, but provides for snap locking and key unlocking of the shell. As shown, it has four of the bottles 20, each with a valve 22 operated by a push button 74 and dispensing liquid from the bottle through a discharge spout 85. Instead of the latching members 56 and 60 of FIG. 8, it is provided with a key-actuated lock.

As shown, such lock comprises a pair of elongate, rigid, tab members 115 rising from the inside face of bottle-holding shell part 116 at opposite sides, respectively, and staggered forwardly and backwardly, respectively of a recess 117 provided in such inside face of shell part 116 for receiving the end of a separate key 118. The tab members 115 have hook portions 115*a* at their ends immediately adjacent to recess 117 for snap-locking interengagement with a corresponding pair of hook members 119 that depend from the inside face of the front shelf portion 120*a* of cover shell part 120 at opposite sides, respectively, of a key-hole 121 in such front shelf portion of the cover shell part and staggered correspondingly with the staggering of members 115 relative to key-end-receiving recess 117.

Since elongate tab members 115 are attached to bottle-holding shell part 116 only at their end portions remote from recess 117, so that the remainders of their respective lengths are resiliently cantilevered toward the keyhole, oppositely extending pin members 118a, respectively, of key 118 serve to push hook portions 115*a* of such resiliently cantilevered tab members out of locking engagement with hook members 119 when the key is turned clockwise in the keyhole. If the arrangement and staggering of the hook members is the reverse of that shown, the key would be turned counter-clockwise in the keyhole.

In conjunction with the aforedescribed locking means, it is advantageous to provide upwardly cantilevered, elongate, resilient, cutout tabs 122 that oppositely flank such locking means and tend to push up cover shell part 120 upon unlocking disengagement of the hook members.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A liquid dispensing device comprising a shell for enclosing one or more liquid-containing bottles, said shell having a part for receiving and holding said one or more bottles and a cover part for the bottle holding part; one or more elongate bottles adapted to be received and held by said bottle-holding part, each of said one or more bottles having a liquid-dispensing opening with valve means at its bottom, each valve means including a valve body of substantially right angle formation having a first elongate body member containing a valve mechanism, and a second body member extending at substantially right angles to the first body member at one end thereof which is otherwise closed, said second body member being adapted for attachment over the bottom liquid-dispensing opening of the bottle, a discharge spout extending downwardly from said first body member in offset relationship to said second body member, said valve mechanism comprising a plunger slidable within said first body member and having a plunger rod with one end attached to a push button that is adapted to extend through said cover for manual operation by the user of the device for operating said valve means and with a plunger head on the opposite end within and slidable back and forth in said first body member, valve sealing means carried by said plunger rod between said ends thereof, a slideway cap closing the end of said first body member opposite said one end and through which said plunger rod slidably extends, a spring bearing against said headed end of the plunger to normally urge said plunger away from said one end of the first body member and toward said slideway cap so said plunger head will bear against said valve sealing means which will be positioned against said slideway cap over said discharge spout to thereby seal the valve against leakage and to urge said push button into an extended position to be pushed so that said plunger head will pass under said second body member and liquid from said bottle will be discharged through said discharge spout when said push button is pushed, means on the plunger head to hold the spring centered with respect to the plunger head; and means whereby said shell can be attached to a wall, with said bottle or bottles positioned substantially vertically.

2. A liquid dispensing device according to claim 1, wherein the means on the plunger head to hold the spring centered is a central ring positioned to extend from the plunger head into an end of the spring which bears against the head to hold the spring centered with respect to the plunger head.

3. A liquid dispensing device, comprising a shell for enclosing one or more liquid-containing bottles, said shell having a part for receiving and holding said one or more bottles and a cover part for the bottle holding part; one or more elongate bottles adapted to be received and held by said bottle-holding part, each of said one or more bottles having a liquid-dispensing opening at its bottom; valve means removably attached to each of said one or more bottles over said liquid-dispensing opening, each of said valve means including mechanism that is operable back and forth along an axis substantially normal to the longitudinal axis of its associated bottle by means of a push button that is adapted to extend through said cover for manual operation by the user of the device for operating said valve means, and having a downwardly extending, discharge spout through which liquid from its associated bottle will be discharged when the valve means is operated, and resilient means for returning the push button and valve mechanism to closed position; means whereby said shell can be attached to a wall, with said bottle or bottles positioned substantially vertically; and means on said receiving and holding part of said shell for individually removably receiving and holding each of said one or more bottles with valve means attached to allow each of said bottles with valve means attached to be individually and easily removed as desired for cleaning, filling, or replacement, said means for individually receiving and holding including resilient means for accepting and holding each of the one or more bottles.

4. A liquid dispensing device according to claim 3, wherein the resilient means for accepting and holding each of the one or more bottles include resilient arms extending from the receiving and holding part of said shell, each arm having a normal unstressed position, and the one or more arms being positioned so that as each of the one or more bottles are placed in position on the receiving and holding part, at least one of the one or more arms will bend to receive one of the one or more bottles and return at least partially toward unstressed position after receipt of the bottle to hold the one or more bottles in position on the receiving and holding part.

5. A liquid dispensing device according to claim 4, wherein the arms have ends, wherein the one or more bottles have indentations therein to receive the ends of the arms, and the ends of one or more arms are received in the one or more bottles when the one or more bottles are positioned to be held by the bottle holding part.

6. A bottle for use with a liquid-dispensing device wherein the liquid-dispensing device includes a shell for enclosing one or more liquid-containing bottles, said shell having a part for receiving and holding one or more bottles and a cover part for the bottle holding part, valve means adapted to be removably attached to each of the one or more bottles over a liquid-dispensing opening, each of said valve means including mechanism that is operable back and forth along an axis substantially normal to the longitudinal axis of its associated bottle by means of a push button that is adapted to extend through said cover for manual operation by the user of the device for operating said valve means, and having a downwardly extending, discharge spout through which liquid from its associated bottle will be discharged when the valve means is operated, and resilient means for returning the push button and valve mechanism to closed position, means whereby said shell can be attached to a wall, with said bottle or bottles positioned substantially vertically, and means on said receiving and holding part of said shell for individually removably receiving and holding each of the one or more bottles with valve means attached to allow each of said bottles with valve means attached to be individually and easily removed as desired for cleaning, filling, or replacement, said bottle comprising a liquid holding portion for holding a liquid to be dispensed by the liquid-dispensing device; a liquid-dispensing opening at the bottom of the bottle when the bottle is mounted in the liquid dispensing device; means for removably attaching a valve means over said liquid-dispensing opening; check valve means associated with said liquid-dispensing opening to allow fluid to flow from the bottle but not back into the bottle; alignment means on the bottle cooperable with the valve means to ensure proper alignment of the valve means removably attached to the means for removably attaching the valve means over the liquid-dispensing opening; and means for allowing air to flow into the bottle as liquid flows from the bottle.

7. A bottle for use with a liquid-dispensing device according to claim 6, wherein the alignment means is a stop means adjacent the means for removably attaching the valve means over the liquid-dispensing opening adapted to abut a tab extending from the valve means when in proper alignment with the bottle.

8. A liquid dispensing device, comprising a shell for enclosing one or more liquid-containing bottles, said shell having a part for receiving and holding said one or more bottles and a cover part for the bottle holding part, said cover part being openable with respect to the bottle holding part; one or more elongate bottles adapted to be received and held by said bottle-holding part, each of said one or more bottles having a liquid-dispensing opening at its bottom; valve means attached to each of said one or more bottles over said liquid-dispensing opening, each of said valve means including mechanism that is operable back and forth along an axis substantially normal to the longitudinal axis of its associated bottle, and having a downwardly extending, discharge spout through which liquid from its associated bottle will be discharged when the valve means is operated, and resilient means for returning the valve mechanism to closed position; a push button associated with each of the valve means; an opening in the cover for each of the push buttons through which the respective push button extends to allow manual operation of the push button by the user of the device for operating the valve means and to allow the push buttons to remain associated with their respective valve means when the cover part is opened; flange means extending from a portion of the push button that remains behind the cover during normal operation of the device so that the push button can not pass through the hole; means whereby said shell can be attached to a wall, with said bottle or bottles positioned substantially vertically; and means on said receiving and holding part of said shell for individually removably receiving and holding each of said one or more bottles with valve means attached whereby each of said bottles with valve means attached may be individually and easily removed as desired for cleaning, filling, or replacement.

9. A liquid dispensing device according to claim 8, wherein the flange means is a flange extending at least partially circumferentially around a portion of the push button that remains behind the cover during normal operation of the device.

10. A liquid dispensing device according to claim 9, wherein the flange means extends circumferentially around the top portion of the push button.

* * * * *